US006807938B2

(12) United States Patent
Majewski et al.

(10) Patent No.: US 6,807,938 B2
(45) Date of Patent: Oct. 26, 2004

(54) POST-RETARD FUEL LIMITING STRATEGY FOR AN ENGINE

(75) Inventors: Michael A. Majewski, Joliet, IL (US); James T. Beaucaire, Glen Ellyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/338,399

(22) Filed: Jan. 8, 2003

(65) Prior Publication Data

US 2004/0129247 A1 Jul. 8, 2004

(51) Int. Cl.[7] ..... F00D 13/04

(52) U.S. Cl. ..... 123/320; 123/446; 123/323; 123/533

(58) Field of Search ..... 123/352, 533, 123/532, 531, 557, 332, 446, 319, 198 D, 198 DB, 320, 323, 321, 502

(56) References Cited

U.S. PATENT DOCUMENTS 4,182,492 A * 1/1980 Albert et al. ..... 239/92
4,593,669 A * 6/1986 Igarashi ..... 123/502
5,048,480 A * 9/1991 Price ..... 123/321
5,996,558 A * 12/1999 Ouellette et al. ..... 123/506
6,148,805 A * 11/2000 Bartley et al. ..... 123/568.28
6,257,203 B1 * 7/2001 Lei ..... 123/446
6,283,090 B1 * 9/2001 Harmon ..... 123/321
6,446,603 B1 * 9/2002 Bonse et al. ..... 123/446
6,644,277 B2 * 11/2003 Blass et al. ..... 123/446
6,662,784 B1 * 12/2003 Breeden ..... 123/446
6,681,740 B1 * 1/2004 Majewski et al. ..... 123/320

* cited by examiner

*Primary Examiner*—John T. Kwon
(74) *Attorney, Agent, or Firm*—Dennis Kelly Sullivan; Susan L. Lukasik; Jeffrey P. Calfa

(57) ABSTRACT

An engine (10) having a control system (24) that executes a control strategy (44) for limiting engine fueling upon deactivation of an engine retarder. Upon deactivation of the retarder, the strategy immediately shuts off fueling by setting the maximum fueling limit MFLMX to zero via setting of a latch function (42). Fueling continues to be shut off so long as the difference between a desired pressure for the hydraulic fluid used to force fuel into the engine combustion chambers and actual pressure of the hydraulic fluid (ICP_ERR) equals or exceeds a value (ICP_VRE_ERR) from a map (48) correlated both with the speed (N) at which the engine is running and with governed engine fueling (MFGOV) appropriate for the load on the engine at the engine running speed. Once that difference ceases to equal or exceed a value from the map (48), the latch function is reset, and the limit value for fueling provided by the strategy increases withtime according to a map (54).

10 Claims, 2 Drawing Sheets

POST-RETARD FUEL LIMITING STRATEGY FOR AN ENGINE

FIELD OF THE INVENTION

This invention relates generally to internal combustion engines for propelling motor vehicles, and particularly to fueling strategies for such engines. More specifically it relates to a strategy for limiting fueling after an engine retarder that had been activated to slow an engine by augmenting back-pressure on the engine has been deactivated to discontinue the augmentation of back-pressure.

BACKGROUND OF THE INVENTION

A known technique for retarding an internal combustion engine comprises augmenting engine back-pressure. One way of doing this comprises restricting the exhaust gas flow from the engine. In a conventional camshaft engine, a valve that is disposed in the exhaust system, sometimes called an exhaust brake, can be operated to restrict the exhaust gas flow. In an engine that has variable valve actuation, the individual cylinder exhaust valves may be actuated in a manner that creates tho desired restriction.

Certain diesel engines have fuel injection systems that utilize hydraulic fluid under pressure to force fuel into engine combustion chambers. The hydraulic fluid is supplied to a respective fuel injector at each engine cylinder. When a valve mechanism of a fuel injector is operated by an electric signal from an engine control system to inject fuel into the respective cylinder, the hydraulic fluid is allowed to act on a piston in the fuel injector to force a charge of fuel into the respective combustion chamber.

SUMMARY OF THE INVENTION

The present invention arises out of the observation that when engine retarding is accompanied by an increase in pressure of the hydraulic fluid used to force fuel into engine combustion chambers, the pressure may be undesirably high when the retarding ends. Such a condition can lead to undesirable effects in the combustion chambers, such as poor combustion quality and even misfire. In turn, such effects can adversely impact tailpipe emissions and/or drivability of the motor vehicle being propelled by the engine.

The present invention is directed toward a solution for minimizing, and ideally eliminating, such consequences by employing a novel strategy in the engine control system to limit engine fueling upon deactivation of an engine retarder. Upon deactivation of the engine retarder, the strategy immediately shuts off fueling and keeps the fueling shut off so long as the difference between a desired pressure for the hydraulic fluid used to force fuel into the combustion chambers and actual pressure of the hydraulic fluid equals or exceeds a value correlated both with the speed at which the engine is running and with governed engine fueling appropriate for the load on the engine at the engine running speed. Once the difference between the desired hydraulic fluid pressure and actual hydraulic fluid pressure ceases to equal or exceed a value correlated both with engine running speed and with governed engine fueling appropriate for the engine load at the engine running speed, the control system begins to increase the limit value. A map of fueling limit values versus time is used to increase the limit value as a function of time.

Accordingly, one generic aspect of the present invention relates to an internal combustion engine comprising a fueling system that uses hydraulic fluid for forcing fuel into engine combustion chambers and an engine control system for controlling various aspects of engine operation including fueling of the engine combustion chambers by the fueling system and the pressure of hydraulicfluid that forces fuel into the combustion chambers. The engine also comprises a mechanism for retarding the engine in consequence of the control system activating an engine retarder and for discontinuing engine retarding upon deactivation of the engine retarder.

In consequence of deactivation of the engine retarder, the engine control system initially limits engine fueling to a limit value, zero fueling is preferred, for as long as the difference between a desired pressure for the hydraulic fluid and actual pressure of the hydraulic fluid equals or exceeds a value correlated both with the speed at which the engine is running and with governed engine fueling appropriate for the load on the engine at the engine running speed. Once the difference between the desired hydraulic fluid pressure and actual hydraulic fluid pressure ceases to equal or exceed a value correlated both with engine running speed and with governed engine fueling appropriate for the engine load at the engine running speed, the control system begins to increase the limit value.

Another generic aspect relates to an internal combustion engine comprising a fueling system that uses hydraulic fluid for forcing fuel into engine combustion chambers and an engine control system for controlling various aspects of engine operation including fueling of the engine combustion chambers by the fueling system and the pressure of hydraulic fluid that forces fuel into the combustion chambers.

The engine control system comprises plural fueling limit sources providing plural fueling limits for fueling the engine, one of the fueling limit sources being effective, upon the control system deactivating an engine retarder, to impose an initial fueling limit on engine fueling and at a later time increase the fueling limit above the initial fueling limit. A minimum selection function selects the smallest valued fueling limit from the plural fueling limit sources and uses it to limit fueling.

Still another generic aspect relates to a control system for an internal combustion engine comprising a processor for processing various data to develop data for control of various engine functions, including control of hydraulic fluid pressure used by a fueling system to force fuel into engine combustion chambers and control of engine fueling. Upon the processor developing data calling for deactivation of an engine retarder that has been retarding the engine, the processor executes an algorithm that develops fueling limit data for imposing an initial limit on engine fueling, zero fueling being preferred, and at a later time increasing the limit above the initial limit.

Still another generic aspect relates to a method for limiting fueling of an internal combustion engine having a fueling system that utilizes hydraulic fluid under pressure to force fuel into engine combustion chambers when an engine retarder that had been activated to operate a mechanism for augmenting back-pressure on the engine to retard the engine is deactivated to discontinue augmenting back-pressure on the engine and hence discontinue retarding the engine. In consequence of deactivation of the engine retarder, engine fueling is initially limited to a limit value, zero fueling being preferred, as long as the difference between a desired pressure for the hydraulic fluid and actual pressure of the hydraulic fluid equals or exceeds a value correlated both with the speed at which the engine is running and with governed engine fueling appropriate for the load on the engine at the engine running speed. Once the difference between the desired hydraulic fluid pressure and actual hydraulic fluid pressure ceases to equal or exceed a value correlated both with engine running speed and with governed engine fueling appropriate for the engine load at the engine running speed, the limit value begins to be increased.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
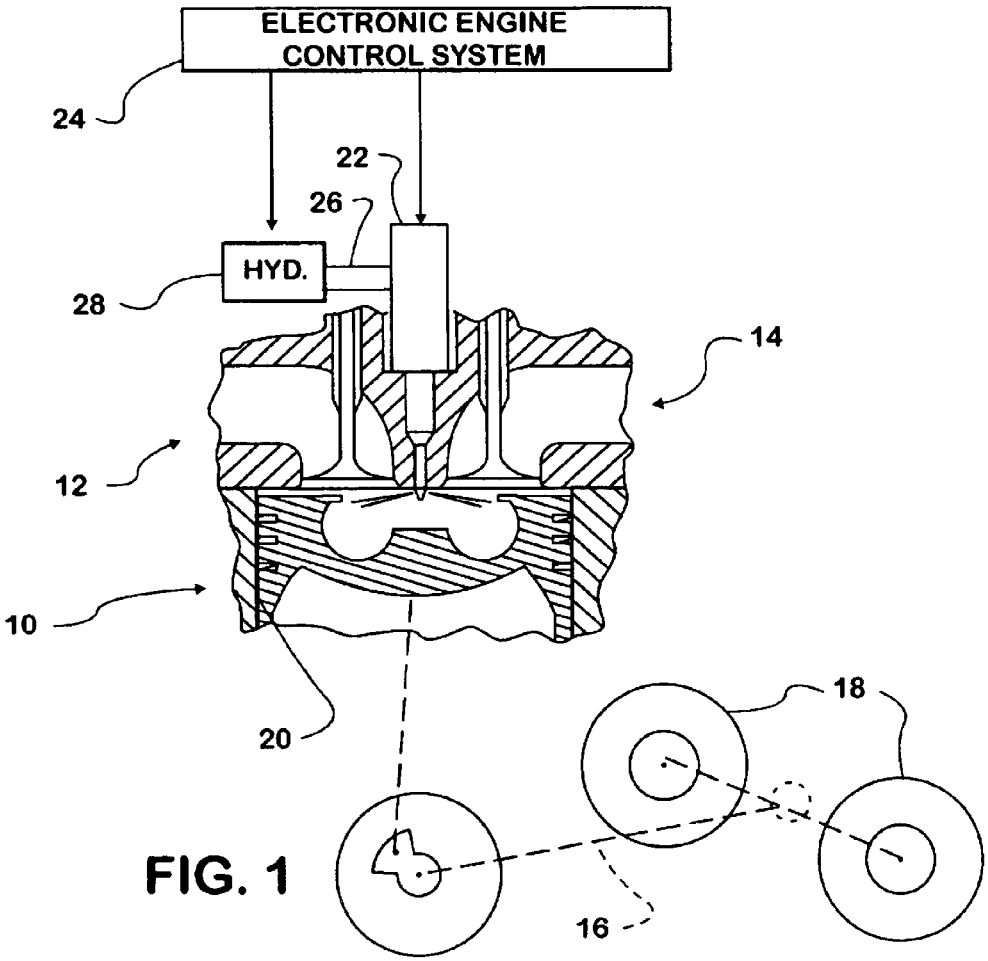
FIG. 1 is a general schematic diagram of an exemplary internal combustion engine in accordance with principles of the present invention.

FIG. 1 shows an exemplary internal combustion engine 10 having an intake system 12 through which air for combustion enters the engine and an exhaust system 14 through which exhaust gas resulting from combustion exits the engine. Engine 10 is, by way of example, a diesel engine that may comprise a turbocharger (not specifically shown in the drawing). When used in a motor vehicle, such as a truck, engine 10 is coupled through a drivetrain 16 to driven wheels 18 propel the vehicle.

Engine 10 comprises cylinders 20 forming combustion chambers into which fuel is injected by fuel injectors 22 to form a mixture with air that has entered through intake system 12. The mixture combusts under pressure to power the engine, and hence propel the vehicle. Gas resulting from combustion is exhausted through exhaust system 14.

Fuel injectors 22 are under the control of an engine control system 24 that comprises one or more processors that process various data to develop data for controlling various aspects of engine operation including controlling pressure of hydraulic fluid 26 supplied to fuel injectors 22 and the timing of operation of valve mechanisms in the fuel injectors. Engine 10 comprises a hydraulic system 28 that provides hydraulic fluid 26 and that controls the hydraulic fluid pressure, which is also sometimes known as injection control pressure.

When a valve mechanism of a fuel injector 22 is operated by an electric signal from engine control system 24 to inject fuel into the respective cylinder, the hydraulic fluid 26 is enabled to act on a piston in the fuel injector to force a charge of fuel into the respective combustion chamber. Fuel injectors of this general type are disclosed in various prior patents.

Figure 2:
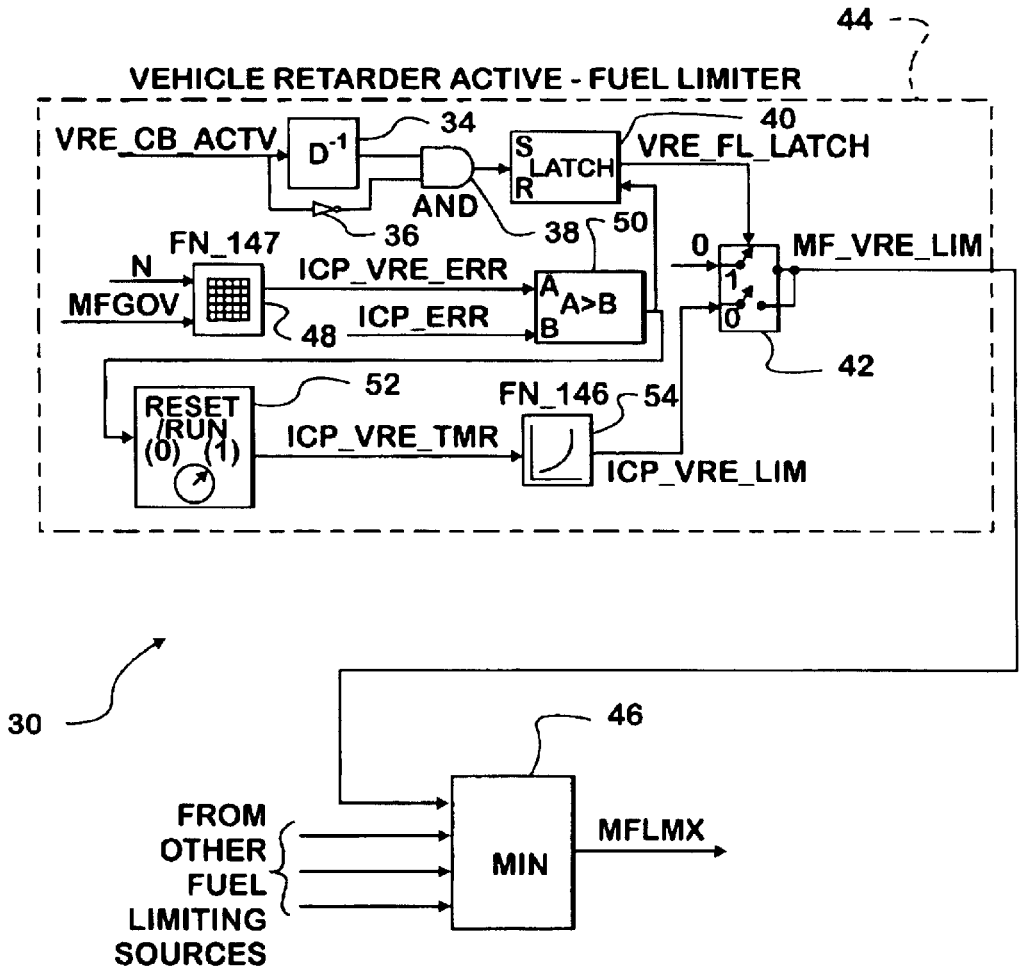
FIG. 2 is a schematic diagram of a portion of an engine control strategy pertinent to the present invention.

Principles of the inventive strategy 30 are disclosed in FIG. 2. The strategy is part of the overall engine control strategy and implemented by an algorithm that is repeatedly executed by a processor, or processors, of engine control system 24.

One way of retarding the motion of a vehicle that is being propelled by engine 10 is to augment the exhaust back-pressure in one of the ways described earlier. A command to retard the vehicle may therefore be effective to restrict the exhaust gas flow and thereby increase back-pressure on the engine. It is upon the engine retarder being deactivated that the present invention becomes effective.

A data value VRE_CB_ACTV changes from a "1" to a "0" upon the engine retarder being deactivated by engine control system 24. A store function 34 stores the value of VRE_CB_ACTV from the immediately prior iteration of the algorithm that implements the inventive strategy. An inverting function 36 inverts the value of VRE_CB_ACTV. Consequently when the value for VRE_CB_ACTV changes from a "1" to a "0", an AND function 38 is effective to set a latch function 40.

Latch function 40 in turn changes the state of a switch function 42 to cause the switch function to output a "0" as the data value for a parameter MF_VRE_LIM that represents a fueling limit value being requested by a fuel limiting source 44 identified in FIG. 2 as Vehicle Retarder Active-Fuel Limiter. The parameter MF_VRE_LIM is only one of plural fuel limiting parameters that forms an input to a minimum selection function 46.

Minimum selection function 46 selects the smallest valued of the data inputs to it and provides that selection as the data value for a parameter MFLMX that sets a maximum limit on engine fueling.

The strategy also uses a map 48 that contains error values correlated both with the speed at which the engine is running and with governed engine fueling appropriate for the load on the engine at the engine running speed. In other words, for various combinations of engine running speed and governed engine fueling, there is a corresponding error value.

The data value of a parameter N represents engine running speed, and the data value of a parameter MFGOV represents governed engine fueling. Both are inputs to map 48, and upon processing of that speed and fueling data in accordance with the map, a corresponding error value from the map is developed as a parameter ICP_VRE_ERR.

A comparison function 50 compares the value of ICP_VRE_ERR and the value of a parameter ICP_ERR. ICP_ERR represents the difference between a desired pressure for the hydraulic fluid, also sometimes called desired injection control pressure, and actual pressure of the hydraulic fluid, also sometimes called actual injection control pressure. As long as the value for ICP_VRE_ERR does not exceed the value for ICP_ERR, comparison function 50 provides a "0" to both latch function 40 and to a timer function 52. When the value for ICP_VRE_ERR exceeds the value for ICP_ERR, comparison function 50 provides a "1" to both latch function 40 and to timer function 52.

Upon comparison function providing a "1", latch function 40 is reset, and timer function commences timing. Resetting of latch function 40 switches switch function back to a state where the prior forced zero fueling limit is removed. The value for MF_VRE_LIM is now set from a map 54 that contains fueling limit values correlated with time. In general, the values become larger withtime, which now provides an input for processing because timer function 52 has commenced running. The result is that the value for MF_VRE_LIM begins to increase as a function of time.

If the other fueling limit values are larger, then the value for MFLMX is the value of MF_VRE_LIM. In such a case, the engine fueling limit is gradually increased as the engine comes off a retard. This can serve to minimize, and ideally eliminate, undesired effects, as discussed earlier.

The foregoing description has shown that upon deactivation of an engine retarder, fuel limiting is accomplished by the disclosed strategy 44 in concert with any other fuel limiting strategies that may be present in an engine control system. Depending on specific engine operating conditions, strategy 44 may set the maximum fueling limit to the exclusion of others, as the engine comes off a retard.

While a presently preferred embodiment of the invention has been illustrated and described, it should be appreciated that principles of the invention apply to all embodiments falling within the scope of the following claims.

What is claimed is:

1. An internal combustion engine comprising:

a fueling system that uses hydraulic fluid for forcing fuel into engine combustion chambers;

an engine control system for controlling various aspects of engine operation including fueling of the engine combustion chambers by the fueling system and the pressure of hydraulic fluid that forces fuel into the combustion chambers; and a mechanism for retarding the engine in consequence of the control system activating an engine retarder and for discontinuing engine retarding upon deactivation of the engine retarder, wherein in consequence of deactivation of the engine retarder, the engine control system initially limits engine fueling to a limit value so long as the difference between a desired pressure for the hydraulic fluid and actual pressure of the hydraulic fluid equals or exceeds a value correlated both with the speed at which the engine is running and with governed engine fueling appropriate for the load on the engine at the engine running speed, but once the difference between the desired hydraulic fluid pressure and actual hydraulic fluid pressure ceases to not equal or exceed a value correlated both with engine running speed and with governed engine fueling appropriate for the engine load at the engine running speed, the control system begins to increase the limit value.

2. An internal combustion engine as set forth in claim 1 wherein once the difference between the desired hydraulic fluid pressure arid actual hydraulic fluid pressure ceases to equals or exceed a value correlated both with the engine running speed and with governed engine fueling appropriate for the engine load at the engine running speed, the control system begins to increase the limit value in accordance with a map of fueling limit values versus time.

3. An internal combustion engine as set forth in claim 2 wherein the engine control system initially limits engine fueling to a limit value of zero fueling.

4. An internal combustion engine comprising:

a fueling system that uses hydraulic fluid for forcing fuel into engine combustion chambers;

an engine control system for controlling various aspects of engine operation including fueling of the engine combustion chambers by the fueling system and the pressure of hydraulic fluid that forces fuel into the combustion chambers, wherein the engine control system comprises plural fueling limit sources providing plural fueling limits for fueling the engine, one of the fueling limit sources being effective, upon the control system deactivating an engine retarder, to impose an initial fueling limit on engine fueling and at a later time increase the fueling limit above the initial fueling limit, and a minimum selection function for selecting the smallest valued fueling limit from the plural fueling limit sources upon the control system deactivating the engine retarder.

5. An internal combustion engine comprising:

a fueling system that uses hydraulic fluid for forcing fuel into engine combustion chambers:

an engine control system for controlling various aspects of engine operation including fueling of the engine combustion chambers by the fueling system and the pressure of hydraulic fluid that forces fuel into the combustion chamber, wherein the engine control system comprises plural fueling limit sources providing plural fueling limits for fueling the engine, one of the fueling limit sources being effective, upon the control system deactivating an engine retarder, to impose an initial fueling limit on engine fueling and at a later time increase the fueling limit above the initial fueling limit, and a minimum selection function for selecting the smallest valued fueling limit from the plural fueling limit sources, wherein the one fueling limit source imposes the initial fueling limit on engine fueling so long as the difference between a desired pressure for the hydraulic fluid and actual pressure of the hydraulic fluid equals or exceeds a value correlated both with the speed at which the engine is running and with governed engine fueling appropriate for the load on the engine at the engine running speed, but once the difference between the desired hydraulic fluid pressure and actual hydraulic fluid pressure ceases to equal or exceed a value correlated both with the engine running speed and with governed engine fueling appropriate for the engine load at the engine running speed, the one fueling limit source begins to increase the fueling limit.

6. An internal combustion engine as set forth in claim 5 wherein once the difference between the desired hydraulic fluid pressure and actual hydraulic fluid pressure ceases to equal or exceed a value correlated both with the engine running speed and with governed engine fueling appropriate for the engine load at the engine running speed, the one fueling limit source begins to increase the limit value in accordance with a map of fueling limit values versus time.

7. An internal combustion engine as set forth in claim 6 wherein the one fueling limit source initially limits engine fueling to a limit value of zero fueling.

8. A method for Limiting fueling of an internal combustion engine having a fueling system that utilizes hydraulic fluid under pressure to force fuel into engine combustion chambers when an engine retarder that had been activated to operate a mechanism for augmenting back-pressure on the engine to retard the engine is deactivated to discontinue augmenting back-pressure on the engine and hence discontinue retarding the engine, the method comprising:

in consequence of deactivation of the engine retarder, initially limiting engine fueling to a limit value so long as the difference between a desired pressure for the hydraulic fluid and actual pressure of the hydraulic fluid equals or exceeds a value correlated both with the speed at which the engine is running and with governed engine fueling appropriate for the load on the engine at the engine running speed, but once the difference between the desired hydraulic fluid pressure and actual hydraulic fluid pressure ceases to equal or exceed a value correlated both with engine running speed and with governed engine fueling appropriate for the engine load at the engine running speed, beginning to increase the limit value.

9. A method as set forth in claim 8 wherein the step of beginning to increase the limit value comprises increasing the limit value as a function of time in accordance with a map of fueling limit values versus time.

10. A method as set forth in claim 8 wherein the step of initially limiting engine fueling to a limit value comprises initially limiting engine fueling to a value of zero fueling.

* * * * *